US009147931B1

(12) United States Patent
Eubanks et al.

(10) Patent No.: US 9,147,931 B1
(45) Date of Patent: Sep. 29, 2015

(54) METAL-FREE MAGNETIC CONDUCTOR SUBSTRATES FOR PLACEMENT-IMMUNE ANTENNA ASSEMBLIES

(71) Applicant: Sandia Corporation, Albuquerque, NM (US)

(72) Inventors: Travis Wayne Eubanks, Albuquerque, NM (US); Hung Loui, Albuquerque, NM (US); Jacob Jeremiah McDonald, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 351 days.

(21) Appl. No.: 13/833,515

(22) Filed: Mar. 15, 2013

(51) Int. Cl.
*H01Q 9/28* (2006.01)
*H01Q 1/36* (2006.01)
*H01Q 9/16* (2006.01)

(52) U.S. Cl.
CPC ... *H01Q 1/36* (2013.01); *H01Q 9/16* (2013.01)

(58) Field of Classification Search
CPC ..... H01Q 9/0407; H01Q 9/065
USPC ..... 343/795, 700 MS
See application file for complete search history.

(56) References Cited

U.S. PATENT DOCUMENTS 5,386,215 A * 1/1995 Brown ..... 343/795
7,158,711 B2 * 1/2007 Tokushima ..... 385/131
8,415,691 B2 * 4/2013 Chen et al. ..... 257/98

OTHER PUBLICATIONS

D. Sievenpiper, et al., High-Impedance Electromagnetic Surfaces with a Forbidden Frequency Band, IEEE Transactions on Microwave Theory and Techniques, vol. 47, No. 11, Nov. 1999, pp. 2059-2074.
A. Erentok, et al., Characterization of a Volumetric Metamaterial Realiation of an Artificial Magnetic Conductor for Antenna Applications, IEEE Trans. Ant. Propagat., vol. 53, No. 1, Jan. 2005, pp. 160-172.
J.H. Loui, et al., Experimental Realization of Low-Loss 3D Isotropic DNG Materials, 3rd International Congress on Advanced Electromagnetic Materials in Microwaves and Optics, London, UK, Aug. 30-Sep. 4, 2009, pp. 315-317.
T.W. Eubanks, et al., Thin Magnetic Conductor Substrate for Placement-Immune, Electrically-Small Antennas, Sandia Technical Report SAND2011-6158, Sandia National Laboratories, Sep. 2011, pp. 1-38.

* cited by examiner

*Primary Examiner* — Hoang V Nguyen
(74) *Attorney, Agent, or Firm* — Scott B. Stahl

(57) ABSTRACT

A magnetic conductor substrate produced for mounting to an antenna includes a sheet of dielectric lattice material having a length, a width and a thickness that is less than the length and less than the width. Within the sheet of dielectric lattice material is disposed an array of dielectric elements.

20 Claims, 3 Drawing Sheets

METAL-FREE MAGNETIC CONDUCTOR SUBSTRATES FOR PLACEMENT-IMMUNE ANTENNA ASSEMBLIES

This invention was developed under Contract DE-AC04-94AL85000 between Sandia Corporation and the U.S. Department of Energy. The U.S. Government has certain rights in this invention.

FIELD

The present work relates generally to antennas and, more particularly, to magnetic conductor substrates for placement-immune antenna assemblies.

BACKGROUND

An antenna assembly whose antenna operates effectively, regardless of the location/environment where the assembly is placed, is referred to as placement-immune. By building an antenna on a substrate of magnetic conductor material, the radiated field will be positively reinforced in the desired radiation direction instead of being negatively affected by the environment. This approach, which has been discussed thoroughly in theoretical research, presents a difficult problem, namely, how to build magnetic conductor materials necessary for in-phase field reflections without requiring substantially thick substrates at low frequencies.

The magnetic conductor substrate must be carefully designed to suit the antenna's frequency dependent needs. Such a substrate is also referred to herein as an artificial magnetic conductor (AMC) substrate, or simply an AMC. AMCs have been created with internal electrically conductive metal components (metal inclusions) to create inductor-capacitor based surface resonances for in-phase reflection of electromagnetic waves. These metal inclusions limit the minimal thickness of the substrate. Sievenpiper style high-impedance surfaces have been used to artificially create magnetic conductors at specific frequencies by making an open circuit boundary condition on the surface of a substrate for incoming electromagnetic waves. The Sievenpiper AMC requires via holes and capacitive patches above a ground plane to act as resonant inductor-capacitor circuits, and its minimal thickness is limited by the interior metal required to create the resonant circuits. Other types of AMCs have been produced by embedding curved metal strips into dielectrics such that the metal strips create resonant inductor-capacitor circuits.

It is desirable in view of the foregoing to provide for an AMC that is thinner and more flexible than conventional AMCs.

DETAILED DESCRIPTION

Example embodiments of the present work provide an AMC with in-phase field reflections without using internal electric conductors. The absence of internal electric conductors permits the substrate thickness to be minimized. Electric and magnetic dipole moments originate from resonances associated with dielectric rods that comprise the building blocks of the substrate. For a dielectric rod whose length is aligned with an incident plane wave's electric field vector, the resonant frequency of the associated electric dipole moment corresponds to the length of the rod, whereas the resonant frequency of the associated magnetic dipole moment corresponds to the circumference of the rod. Near these engineered resonances, the effective index of refraction of the dielectric material may be significantly higher than its bulk values. This property allows narrow-band magnetic conductor effects to be created without the necessity of metal inclusions such as described above, and therefore with correspondingly thinner substrates. A properly operating magnetic conductor will reflect the antenna's fields with constructive interference when the antenna radiates into the magnetic conductor.

Example embodiments of the present work create in-phase field reflections by using a quarter-wavelength short phenomenon, which operates effectively over a limited bandwidth. If the substrate thickness equals a quarter of its guided wavelength, then fields incident perpendicularly to a surface of the substrate will be reflected with the same phase from that surface. The magnetic resonance of high dielectric constant ceramic rods within the substrate is used to suppress surface waves inside the substrate, while maintaining zero phase change reflections through operation of the aforementioned quarter-wavelength short phenomenon. Electromagnetic fields incident on a quarter-wave thick substrate see an input impedance (looking from surrounding air into the substrate) equivalent to an open circuit. This effectively provides the same in-phase field reflection as is associated with a wave impedance that approaches infinity. It can be shown that, as the input impedance approaches infinity, the reflection coefficient at the substrate surface where the electromagnetic field is incident approaches positive unity.

In an ideal antenna/AMC assembly, the AMC would be excited at the frequency of in-phase reflection, so the antenna should have a resonant frequency that coincides with that of the AMC. In some embodiments, the target resonant frequency is the 433 MHz European ISM band.

Figure 1:
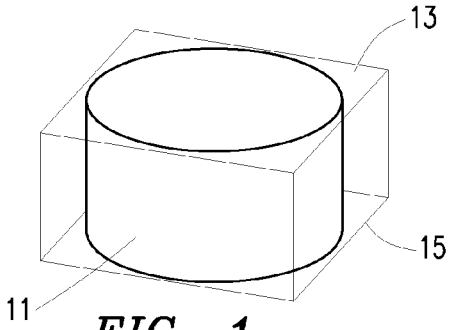
FIG. 1 diagrammatically illustrates a unit cell model (not shown to scale) for use in designing an AMC according to example embodiments of the present work.

FIG. 1 diagrammatically illustrates a unit cell model used to design an AMC according to example embodiments of the present work. The unit cell model includes a dielectric element 11 (a ceramic element in some embodiments) configured as a right circular cylinder (also referred to herein as a dielectric rod) and having a dielectric constant of approximately 3600. The material 13 surrounding the dielectric rod 11 defines a rectangular prism. In various embodiments, this surrounding material (also referred to herein as the lattice material) is Plexiglas (dielectric constant around 3.6), Makrolon (dielectric constant around 2.8) or Polydimethylsiloxane (PDMS, dielectric constant between 2.3 and 2.8). Plexiglas and Makrolon are relatively rigid materials. PDMS is a relatively flexible material that is, for example, capable of conforming to non-planar surfaces, which would permit adaptation of the AMC to many different mounting/operating environments. Makrolon is easier to cut than Plexiglas, and therefore provides advantages over Plexiglas in terms of manufacturability.

The cylinder of FIG. 1 has a diameter of 9 mm and a height of 5 mm, and is centered inside the surrounding rectangular prism, which has the dimensions 9.5×9.5×5 mm. The unit cell is backed by a perfect electric conductor sheet 15 to provide a quarter-wavelength short. The conductor (e.g., copper) sheet 15 ensures that there is no transmission through the substrate. Any energy not reflected by the substrate is either absorbed or radiated out of the sides of the substrate.

Figure 2:
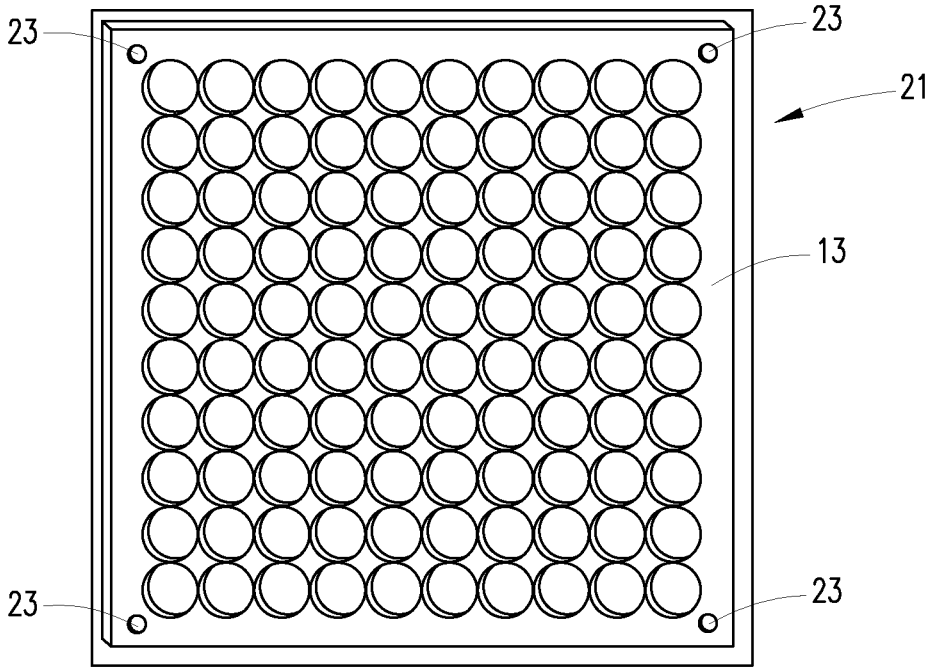
FIG. 2 diagrammatically illustrates a sheet of lattice material used as a component of an AMC according to example embodiments of the present work.

FIG. 2 diagrammatically illustrates an AMC lattice design that may be constructed using the unit cell of FIG. 1 according to example embodiments of the present work. The example lattice design of FIG. 2 extends the unit cell into a 10×10 square array. FIG. 2 shows a resulting 100-cell lattice sheet 21 having dimensions 121×121×6 mm. The lattice sheet 21 is made of the material 13 in FIG. 1. The aforementioned lattice sheet size is wide enough to hold a 433 MHz quarter-wavelength monopole antenna above a Rogers 4003 substrate (dielectric constant of 3.55). At 433 MHz, a quarter-wavelength in Rogers 4003 material is 92 mm. The actual in-phase reflection frequency of the AMC may possibly be lower than the expected 433 MHz if the dielectric constant of the cylinders 11 is higher than expected. In this case, meandering techniques may be used to fit a lower frequency antenna onto the substrate. As is known in the art, meandering techniques make it possible to reduce the length of an antenna in one dimension by increasing its electrical length in other dimensions.

Figure 3:
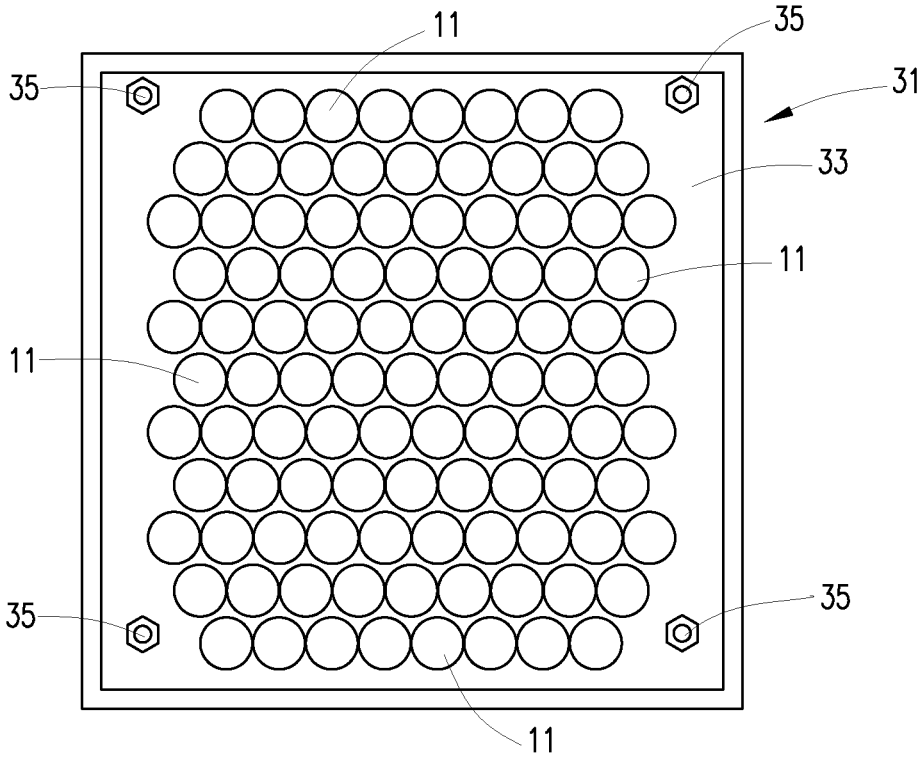
FIG. 3 diagrammatically illustrates an AMC that includes a sheet of lattice material with dielectric elements disposed therein overlaid by cover sheets according to example embodiments of the present work.

FIG. 3 diagrammatically illustrates an AMC according to example embodiments of the present work. The AMC of FIG. 3 has a lattice design generally similar to that of FIG. 2, except the unit cell is rotated around a hexagon and expands that hexagonal structure into a lattice sheet 31 that holds 101 cylinders 11. In FIG. 3, the cylinders 11 are explicitly shown disposed within the lattice sheet 31. As shown in FIG. 3, for each one of a subset of the cylinders 11, six other cylinders 11 immediately surround that cylinder, and are centered on respective vertices of a hexagon that is centered on that cylinder. By thusly expanding the cylinders of the subset into respective hexagonal arrays, there is produced a nearly square AMC structure, and an additional axis of symmetry is established. This provides excellent surface wave suppression in at least six directions from the substrate center. The lattice sheet 31 is made of the material 13 of FIG. 1.

The hexagonal arrangement of FIG. 3 also gives the cylinders 11 tighter coupling, which increases the effective dielectric constant of the AMC, hypothetically decreasing the AMC's in-phase reflection frequency. Note that the rectangular prism at 13 in FIG. 1 is not retained as such in the lattice 31. However, the spacing between the cylinders is the same (0.5 mm) as in the lattice structure of FIG. 2. The lattice sheet 31 has the same dimensions (121×121×6 mm) as the lattice sheet 21 of FIG. 2.

In some embodiments, additional upper and lower sheets of thickness 0.030" are provided as covers overlying opposite surfaces of the lattice sheet to prevent the dielectric elements from falling out of the surrounding lattice material. In some embodiments, the cover sheet material and the lattice sheet material are the same (e.g., Makrolon). FIG. 2 shows four small holes 23 in the lattice sheet 21, near the four corners. These holes 23 receive fasteners that secure the covers to the lattice sheet 21. FIG. 3 shows the top cover 33 in place, secured to the lattice sheet 31 by suitable fasteners 35.

Although the example AMC lattice designs described above relative to FIGS. 2 and 3 define arrays of uniformly spaced dielectric elements 11, various embodiments provide AMC lattice designs that define arrays of non-uniformly spaced dielectric elements. As illustrative examples, in a generally rectangular array of the type shown in FIG. 2, the spacing within the array may be selected such that, proceeding across the lattice from the edges toward the center, the dielectric elements of each illustrated row and column are either progressively closer together, or progressively further apart.

When a sintering furnace bakes ceramics, the ceramics shrink in size. Since the unit cell cylinder 11 of FIG. 1 has a diameter of 9 mm and the cylinder material is known to shrink about 18% in the sintering furnace, a custom die press with a diameter of 10.9 mm would be needed to create the 9 mm cylinder of FIG. 1. However, some embodiments use a commercially available 12.7 mm diameter die press. The resulting cylinders have a larger diameter than the cylinder 11 of the FIG. 1 unit cell, but this increased diameter simply lowers the in-phase reflection frequency in simulated results. In some embodiments, after pressing and sintering, the resulting cylinders have a 10.5 mm diameter. In some embodiments, the 5 mm spacing between unit cell cylinders is retained with the 10.5 mm cylinders, and the lattice sizes are stretched to accommodate the larger diameter cylinders.

Figure 4:
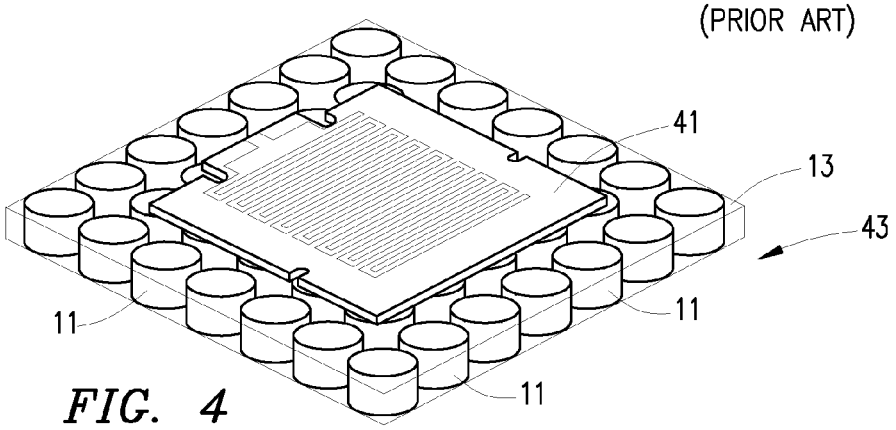
FIG. 4 diagrammatically illustrates an antenna assembly according to example embodiments of the present work.

Quarter-wavelength reflecting substrates such as described above do not require a specific electric field polarization to create in-phase reflections at the substrate surface, because the aforementioned quarter-wavelength short appears as an open at the substrate surface. Therefore, any antenna polarization may be used with the substrate, providing great flexibility for applications of this design. Due to the magnetic resonance of the high dielectric ceramic rods, the substrates of FIGS. 2 and 3 exhibit excellent surface wave suppression for electric fields oriented parallel to the substrate surface. Due to the dual-axis symmetry of the unit cell of FIG. 1, the substrates provide strong symmetrical surface wave suppression in four (FIG. 2) or six (FIG. 3) directions away from the center of the substrate. With high probability, waves traveling at oblique angles would also see high attenuation as they pass through several resonant unit cells. The electric field propagating through the substrate will originate from the propagating electric field on the antenna, and therefore the electric field in the substrate will have the same polarization as the electric field on the antenna. Referring to FIG. 4, there is diagrammatically illustrated a linear antenna 41 positioned over an AMC 43 having the lattice structure of FIG. 2, according to example embodiments of the present work.

Figure 5:
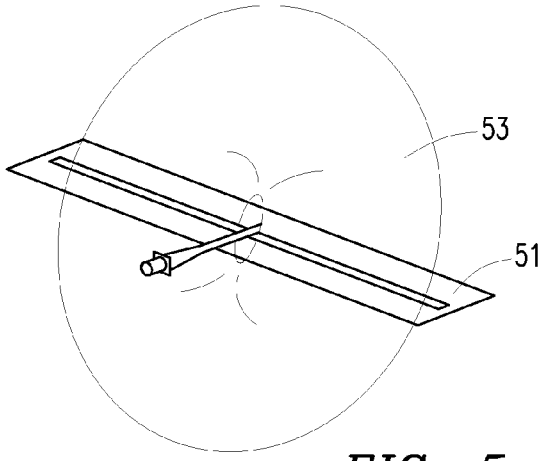
FIG. 5 (PRIOR ART)
FIG. 5 diagrammatically illustrates a conventional half-wave dipole antenna and its radiation pattern.
Figure 6:
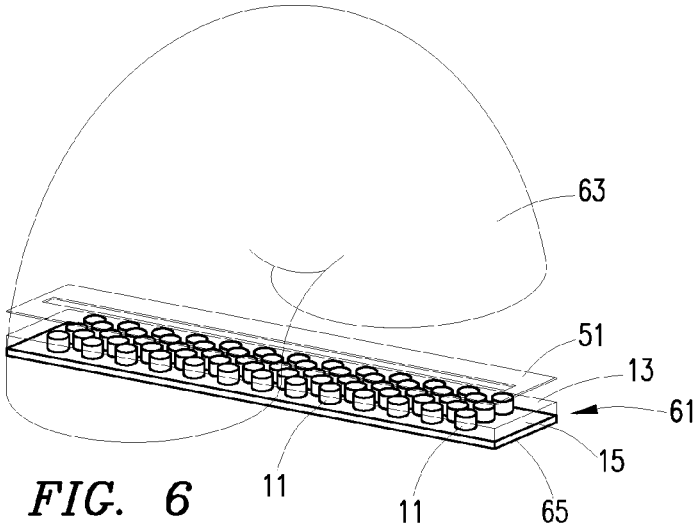
FIG. 6 diagrammatically illustrates an antenna assembly according to example embodiments of the present work, including an antenna such as shown in FIG. 5 coupled to an AMC, and the resulting radiation pattern.

FIG. 5 diagrammatically illustrates a conventional half-wave dipole antenna 51, together with its toroidal omnidirectional radiation pattern 53. Substrates such as those described above are capable of bisecting the radiation pattern 53 of the half-wave dipole antenna 51. FIG. 6 shows an example of an antenna assembly including the antenna of FIG. 5 disposed adjacent an AMC 61 having a lattice structure of the type shown in FIG. 3, according to example embodiments of the present work. In operation, this antenna assembly bisects the antenna's radiation pattern to produce an unbalanced toroid with an enhanced front lobe 63 pointing away from the AMC 61, and a reduced back lobe (not explicitly illustrated) facing toward the AMC 61. As seen in FIG. 6, the length and width dimensions of the AMC 61 are adapted to conform generally to the shape of the antenna 51. With the reduced back lobe, the portion of the environment that is opposite (across the AMC from) the antenna 51 does not significantly affect the front lobe 63. As indicated above, the front lobe 63 is reinforced by the presence of the AMC. Accordingly, the antenna assembly should be oriented such that the substrate surface opposite the antenna (lower surface 65 in FIG. 6) faces the variable environment.

Still referencing FIG. 6, some embodiments provide at 51 a 300 mm half-wave dipole antenna disposed adjacent to and spaced 15 mm from the AMC 61, with the entire antenna assembly having dimensions 21×43×321 mm. The assembly exhibits an input return loss of 5 dB or better over 425-438 MHz, and has a maximum gain ranging from 1.50-3.94 dBi, with variations in the gain corresponding to changes in the environment.

In some embodiments, a high dielectric constant material commercially available from MRA Laboratories, Inc., referred to as HF-402, is used to produce the cylinders 11 of the unit cells. The HF-402 material has a manufacturer stated dielectric constant of 3900+/−300 at 1 kHz, is composed of mostly Barium Titanate, and is RoHS compliant. The material is procured as a powder. For proper binding, the powder is soaked in a binder solution of 30% polyvinyl alcohol and 70% water prior to die pressing. After soaking the HF-402 powder in the binder solution, the resulting powder is ground into finer particles to prepare it for pressing. For each ceramic cylinder created, three grams of the ground powder (with binder included) are inserted into a 12.7 mm diameter die press, which presses the ground powder at 1000 psi. After pressing, the pressed powder is removed from the die press, and baked and sintered according to the temperature profiles provided by the powder manufacturer. In some embodiments, the baked and sintered cylinders have 10.5 mm diameters and 6.2 mm heights, +/−0.1 mm in both dimensions.

Some embodiments use for the unit cell cylinders 11 various materials commercially available from Dielectric Laboratories (DiLabs). These materials have dielectric constants measured by the manufacturer at 1 MHz (as opposed to the aforementioned 1 kHz dielectric constant measurements associated with the HF-402 material). Three DiLabs materials, referred to as BL, BJ, and BN have stated dielectric constants of 2000, 3300, and 4500, respectively, at 1 MHz, with a +/−10-15% tolerance on those values. Because the dielectric constants of the DiLabs materials are specified at a frequency that is a factor of 1000 greater than the frequency at which the HF-402 dielectric constant is specified, there is a higher degree of confidence that the DiLabs materials, when radiated at 433 MHz, will have dielectric constant values similar to their manufacturer-specified values.

Unlike the HF-402 material, the DiLabs materials are already pressed and sintered before they are shipped. This could of course be either a convenience or a detriment to the ceramic designer. Because the materials are pressed before shipping, only a limited number of shapes and sizes are available. However, inasmuch as DiLabs has perfected the pressing and sintering technique for their custom powders, there is enhanced assurance that the ceramic shapes will be produced correctly, without cracks and other asymmetrical material properties. A machine assembly process mixes a liquid binder into the high dielectric constant powder and rolls the mixture into 30 mil thick sheets prior to punching out shapes that fit into the available die presses. A sufficient number of 30 mil thick cylinders with approximately the same 10.5 mm diameter as the aforementioned HF-402 cylinders may then be stacked into the lattice to achieve the aforementioned 6.2 mm cylinder height.

Figure 7:
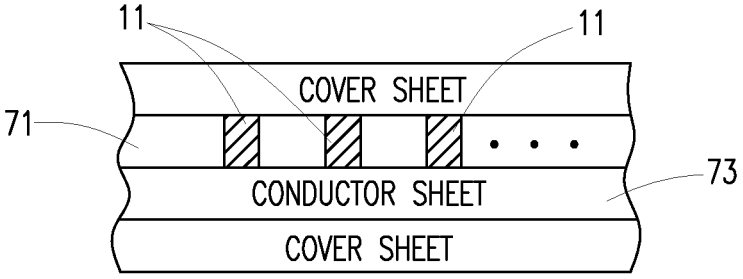
FIG. 7 diagrammatically illustrates an AMC (not shown to scale) according to example embodiments of the present work.

FIG. 7 diagrammatically illustrates an AMC according to example embodiments of the present work. A lattice sheet 71, for example one of the lattice sheets described above, has disposed therein a plurality of dielectric elements 11. One surface of the lattice sheet is backed by a conductor sheet 73. Cover sheets overlie opposite surfaces of the resulting lattice sheet/conductor sheet assembly 71/73.

Figure 8:
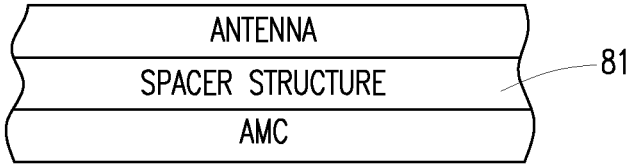
FIG. 8 diagrammatically illustrates an antenna assembly (not shown to scale) according to example embodiments of the present work.

FIG. 8 diagrammatically illustrates an antenna assembly according to example embodiments of the present work. An antenna is disposed adjacent an AMC, for example one of the AMCs described above, at a desired distance from the AMC. The antenna is mounted to the AMC using a suitable spacer structure 81 that holds the antenna at the desired distance from the AMC. In some embodiments, the spacer structure is implemented with a suitable layer of low dielectric spacer material (e.g., Rohacell) interposed between the AMC and the antenna. In some embodiments, the spacer structure is implemented on fasteners that mount the antenna to the AMC, for example, mounting fasteners may carry suitable spacers (e.g., washers) interposed between the antenna and the AMC.

Although example embodiments of the present work are described above in detail, this does not limit the scope of the present work, which can be practiced in a variety of embodiments.

What is claimed is:

1. A magnetic conductor substrate for mounting to an antenna, comprising:

a sheet of dielectric lattice material having a length, a width, and a thickness that is less than said length and less than said width; and an array of dielectric elements disposed within said sheet of dielectric lattice material, wherein the dielectric elements are formed from a first material having a first dielectric constant and the dielectric lattice is formed from a second material having a second dielectric constant, wherein the first dielectric constant is higher than the second dielectric constant, and the thickness of the magnetic conductor substrate equals a length that is a quarter of a guided wavelength of the magnetic conductor substrate.

2. The magnetic conductor substrate of claim 1, wherein said sheet of dielectric lattice material is backed by an electrical conductor sheet.

3. The magnetic conductor substrate of claim 1, wherein said dielectric lattice material is one of Plexiglas, Makrolon and Polydimethylsiloxane.

4. The magnetic conductor substrate of claim 1, wherein said dielectric elements are made of a ceramic material.

5. The magnetic conductor substrate of claim 1, wherein said dielectric elements are configured as right circular cylinders, and have a length equal to the thickness of the sheet of dielectric lattice material.

6. The magnetic conductor substrate of claim 5, wherein the length of the dielectric elements corresponds to a resonant frequency of an associated electric dipole moment of a signal generated by an antenna located on the magnetic conductor substrate, and the dielectric elements have a circumference corresponding to a resonant frequency of an associated magnetic dipole moment of the signal generated by the antenna.

7. The magnetic conductor substrate of claim 1, wherein said array is rectangular, and said dielectric elements are uniformly spaced in said array.

8. The magnetic substrate of claim 1, wherein each one of a subset of said dielectric elements is immediately surrounded in said array by six other said dielectric elements that are centered on respective vertices of a hexagon that is centered on said surrounded dielectric element, and wherein said dielectric elements are uniformly spaced in said array.

9. The magnetic conductor substrate of claim 1, further comprising an antenna, wherein the antenna is configured to transmit and receive a signal, the signal has a frequency in a range of about 425 MHz to about 438 MHz.

10. An antenna assembly, comprising:

a magnetic conductor substrate including a sheet of dielectric lattice material having a length, a width, and a thickness that is less than said length and less than said width, and an array of dielectric elements disposed within said sheet of dielectric lattice material, wherein the thickness of the magnetic conductor substrate equals a length that is a quarter of a guided wavelength of the magnetic conductor substrate, the dielectric elements are formed from a first material having a first dielectric constant, and the dielectric lattice material is formed from a second material having a second dielectric constant, the first dielectric constant is higher than the second dielectric constant; and an antenna mounted to said magnetic conductor substrate and disposed at a predetermined distance from said magnetic conductor substrate.

11. The antenna assembly of claim 10, wherein said length and said width are approximately equal, respectively to a length and a width of said antenna.

12. The antenna assembly of claim 10, wherein said predetermined distance is approximately 15 mm.

13. The antenna assembly of claim 10, wherein said antenna is a half-wave dipole antenna.

14. The antenna assembly of claim 10, wherein said sheet of dielectric lattice material is backed by an electrical conductor sheet.

15. The antenna assembly of claim 10, wherein said dielectric elements are made of a ceramic material.

16. The antenna assembly of claim 10, wherein said dielectric elements are configured as right circular cylinders.

17. The antenna assembly of claim 10, wherein said array is rectangular, and said dielectric elements are uniformly spaced in said array.

18. The antenna assembly of claim 10, wherein each one of a subset of said dielectric elements is immediately surrounded in said array by six other said dielectric elements that are centered on respective vertices of a hexagon that is centered on said surrounded dielectric element, and wherein said dielectric elements are uniformly spaced in said array.

19. A method of producing a magnetic conductor substrate for mounting to an antenna, comprising:

providing a sheet of dielectric lattice material having a length, a width, and a thickness that is less than said length and less than said width; and providing within the sheet of dielectric lattice material an array of dielectric elements, wherein the dielectric elements are formed from a first material having a first dielectric constant and the dielectric lattice material is formed from a second material having a second dielectric constant, wherein the first dielectric constant is higher than the second dielectric constant, the thickness of the magnetic conductor substrate equals a length that is a quarter of a guided wavelength of the magnetic conductor substrate.

20. The method of claim 19, including backing said sheet of dielectric material with an electrical conductor sheet.

* * * * *